United States Patent [19]

Idegren et al.

[11] Patent Number: 4,714,029

[45] Date of Patent: Dec. 22, 1987

[54] LOCKABLE CASSETTE FOR VALUABLE OBJECTS

[75] Inventors: Gustav L. Idegren, Mellösa; Lars-Goran L. Gyllstål, Katrineholm; István V. Bartha, Flen, all of Sweden

[73] Assignee: Inter Innovation AB, Stockholm, Sweden

[21] Appl. No.: 824,398

[22] Filed: Jan. 23, 1986

[30] Foreign Application Priority Data

Feb. 1, 1985 [SE] Sweden ..... 8500455

[51] Int. Cl.[4] ..... E05G 1/00; E05B 49/04; G07D 1/50; G07F 9/06

[52] U.S. Cl. ..... 109/45; 70/278

[58] Field of Search ..... 109/45, 47, 24.1, 53, 109/56, 57; 70/278; 340/825.3

[56] References Cited

FOREIGN PATENT DOCUMENTS

| | | | |
|---|---|---|---|
| 4436 | 10/1979 | European Pat. Off. | 70/278 |
| 44630 | 1/1982 | European Pat. Off. | 70/278 |
| 162171 | 11/1985 | European Pat. Off. | 70/278 |
| 2337398 | 2/1974 | Fed. Rep. of Germany | 109/45 |
| 2225603 | 12/1974 | France | 109/45 |
| 2010375 | 6/1979 | United Kingdom | 70/278 |

*Primary Examiner*—Alfred C. Perham
*Attorney, Agent, or Firm*—Sughrue, Mion, Zinn, Macpeak and Seas

[57] ABSTRACT

A lockable cassette 10 for valuable papers can be inserted into a housing 20. The cassette is closed and locked when removed from the housing, and when inserted therein can be unlocked by electrical activation and opened to access the papers provided that the electrical activation is effected in accordance with a pre-set program. For this purpose there is provided a locking arrangement which includes a programmable memory (171), a comparison circuit (172), and a logic circuit (173). The memory is accessible for programming and is arranged to feed a series of pulses to the comparison circuit, which in turn compares them with a series of pulses fed-in from without to the locking arrangement. The logic circuit blocks the opening of the locking arrangement in the absence of agreement between any two pulses. This blocking of the opening function is not noticeable externally until the whope series of pulses has been compared.

1 Claim, 2 Drawing Figures

20
111
11
121
10
16
12
31
17
122
13
25
15
14

37
BUFFER
33
34
171
25
MEMORY
22
21
23
24
35
172
28
BUFFER
COMP.
26
29
27
LOGIC
173
30
32

LOCKABLE CASSETTE FOR VALUABLE OBJECTS

TECHNICAL FIELD

The present invention relates to a lockable cassette, and more particularly to a lockable cassette, box or the like intended for valuable papers and/or valuable articles.

BACKGROUND PRIOR ART

Devices intended for the safe storage of banknotes and their transportation between different localities, such as shops, banks and post-office localities, etc., are known to the art. For example, European Pat. No. 0004436 describes a banknote handling device, namely a lockable cassette. This cassette is provided with a lockable lid and is adapted for insertion into a housing. When removed from the housing, the cassette is closed and locked and when inserted into the housing a latch which latches a member in the lid is moved to a non-latching position, provided that given electrical activation takes place in accordance with a pre-set program. This activation involves the mutual co-action of components belonging to the cassette and to the housing, this co-action causing a signal of given value or pattern to be delivered to an electric locking device in the cassette in accordance with the set program. This value or pattern has a direct relationship with a locking code selected for the cassette.

A certain amount of criticism has been levelled against arrangements of this kind, to the effect that the number of possible locking codes available is too restricted, accompanied with the risk of unauthorized de-coding, and that the procedure required to change a locking code is too complicated. An increased memory capacity for storing various kinds of information is also desirable.

SUMMARY OF THE INVENTION

The object of the invention is to provide a cassette which will avoid such criticisms and which despite an increased coding and information-storage capacity can be produced at competitive prices. P A cassette, box or the like of the aforesaid kind incorporates, in accordance with the invention, a locking arrangement which includes a programmable memory, a comparison circuit, and a logic circuit.

The memory is constructed so that when the cassette is removed from a housing the memory is accessible externally for programming in the absence of disturbing or destructive measures.

In addition, when in operation it is arranged to feed a series of pulses to the comparison circuit.

The comparison circuit is intended for the comparison of pulses fed from the memory and a series of pulses (locking code) fed into the locking arrangement from without.

In the absence of agreement between two pulses, the logic circuit is effective in blocking the opening function of the locking arrangement, this blocking of the locking arrangement being unnoticeable until a comparison has been made on the whole series of pulses. When agreement is found between all pulses (e.g. 24 pulses), the opening function of the locking arrangement is activated.

BRIEF DESCRIPTION OF THE DRAWING

The invention will now be described in more detail with reference to the accompanying drawing, in which.

PREFERRED EMBODIMENT

Figure 1:
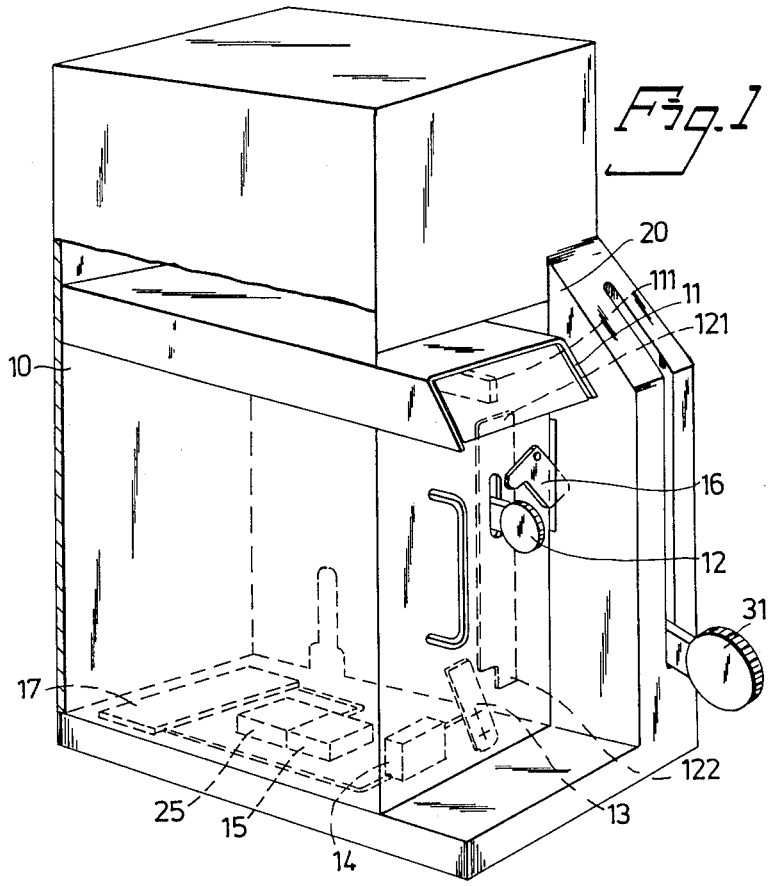
FIG. 1 illustrates schematically the outer contours of a cassette housing according to an earlier known construction.

The cassette 10 illustrated in FIG. 1 comprises an elongated box having an upper end which is covered by an outwardly slidable lid 11. When the cassette is removed from a housing 20, the lid 11 is latched in the closed position by the upper part 121 of an operating bar 12. This part 121 engages a stop 111 in the lid and the operating bar 12 is prevented from downward movement by a latch 13, which adopts a vertical position. When the cassette is inserted into the housing 20, as illustrated in FIG. 1, the operating bar 12 can be moved downwards, the part 121 unblocks the stop 111, and the lid 11 can be slid out. Banknotes present in the cassette can therewith be made accessible to a cashier or a customer with the aid of a withdrawal device 31 for raising the entire cassette, although while the lid is withdrawn it is impossible to remove the cassette from the housing 20 due to the presence of a latch 16, which comes into operation as the operating bar 12 is moved downwards.

Before the lid 11 can be drawn out it is necessary for a contact or switch part 15 in the cassette to co-act with a contact or switch part 25 in the housing 20 upon insertion of the cassette 10 into the housing 20, so that a signal produced, for example, from an external data processor, enters the circuit card 17 of a locking arrangement 17, 14 via the contact parts 25 and 15. If this signal has, or gives rise to a given value or pattern which coincides with a corresponding value or pattern in a memory 171 (see FIG. 2) in the card 17, an operating signal is sent from the card to a relay 14, the armature of which pivots latch 13 to mechanically release the lower part 122 of the operating bar 12. When the lid is closed and the cassette is withdrawn from the housing, the latch 13 is positioned vertically and engages a recess or notch in the part 122, to thereby block any movement of the operating bar 12. FIG. 1 illustrates the situation in which the cassette 10 is inserted correctly in the housing 20 and a correct "unlocking signal" is fed to the card 17, so that the relay 14 is energized and the latch 13 is moved out of its blocking position. The bar 12 can then be lowered and the lid can be slid open.

Figure 2:
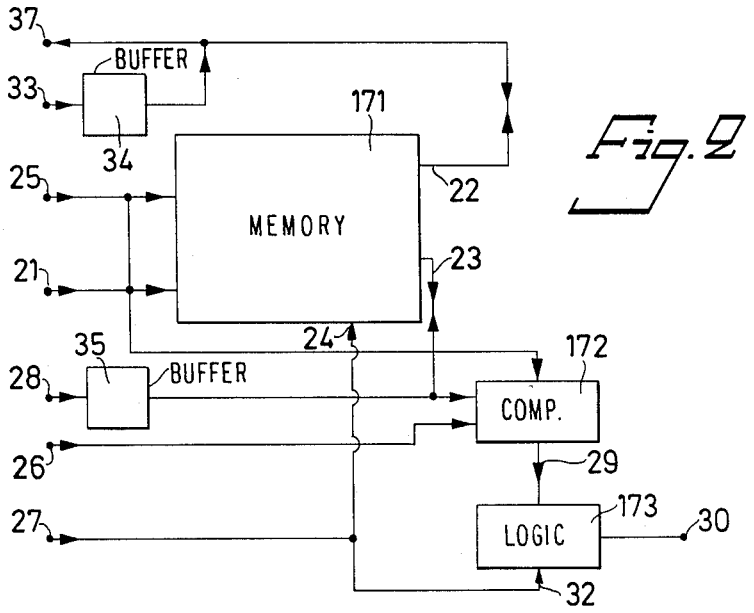
FIG. 2 illustrates a circuit card incorporated in the cassette according to FIG. 1.

In addition to the programmable memory 171, the circuit card 17 of the locking arrangement also incorporates a comparison circuit 172 and a logic circuit 173, as shown in FIG. 2.

The memory 171 stores information such as the serial number of the cassette, the kind of banknotes and the number thereof contained in the cassette, the width of the banknotes, the value of the banknotes, etc., this information being written into and read from the memory via input/output 22. The information is read from the memory via the output 22 and a circuit card output 37. The locking code is written in via an input/output 23, which is also used to transfer the locking code to the comparison circuit 172. In addition to these input/outputs, the memory also incorporates an input 24 for start-reset signals from a circuit card input 27, an input 25 for clock signals, and an input 21 for signals effective to transfer information stored temporarily in one part of the memory to another part of the memory for permanent storage of information (independent of voltages).

Information, such as serial number, etc., is programmed via a circuit card input 33 and a buffer circuit 34 to the input 22. The locking code is inserted, or programmed, via a circuit card input 28 and a buffer circuit 35 to the input 23. Thus, in short, information is programmed by feeding-in a start pulse on the circuit input 27 and transferring the pulse to the input 24; information and code pulses are fed in on the inputs 33 and 28 respectively and transferred to the respective inputs 22 and 23; clock signals are fed to the input 25; additional information and code pulses are fed to the respective inputs 33 and 28 with intermediate clock signals to the input 25; and a signal is then fed to the input 21 for the permanent storage of the earlier, temporarily stored information and code signal.

The memory 171 is also constructed so that when the cassette 10 is withdrawn from the housing 20 and opened by an authorized person with the aid of the relevant locking code, the memory is accessible for programming from without (via a switch in a programmable box), without needing to first take disturbing or destructive measures. The memory is also adapted for the serial infeed of pulses to the comparison circuit 172, thereby greatly decreasing the need for comparison circuits.

The comparison circuit 172 is arranged to compare pulses, pulse for pulse, fed-out of the memory 171 via the output 23 with a series of pulses (locking code) fed-in from an external source via engaged contact parts 25, 15 to an input 26 in the circuit card; in the event of a correct code pulse a comparison results in a signal to the logic circuit 173 via output 29.

The logic circuit 173 is effective to block the opening function of the locking arrangement (via an output 30) in the absence of agreement between two pulses in the comparison circuit, i.e. no current is supplied to the relay 14 in FIG. 1. This blocking of the opening function, however, does not become noticeable externally until the whole series of pulses has been compared. This reduces the risk of the locking code being unlawfully manipulated. One input 32 is connected to the input 27 on the circuit card for resetting pulses.

We claim:

1. A lockable cassette system for accommodating valuable papers or objects, comprising: a cassette (10), a displaceable lid (11) for accessing an interior of the cassette, the cassette being closed and locked when withdrawn from a surrounding housing (20), and when inserted into the housing enabling the electrical activation of a latch (13), said latch having a first position blocking the displacement of the lid, and being movable to a second, non-blocking position provided that said electrical activation takes place in accordance with a pre-set program through the mutual engagement of respective contact members (15, 25) individually mounted on the cassette and the housing, such engagement supplying a predetermined signal pattern to a locking circuit in the cassette in accordance with the pre-set program, wherein:

(a) the locking circuit includes a programmable memory (171), a comparison circuit (172) and a logic circuit (173), (b) the memory is accessible for external programming when the cassette is removed from the housing and opened with the aid of a locking code, without necessitating any disturbing or destructive measures, and when in operation feeds a series of pulses to the comparison circuit, (c) the comparison circuit serially compares, pulse for pulse, pulses fed thereto from the memory with a series of locking code pulses fed thereto from an external control source via the engaged contact members, (d) the logic circuit (173) blocks a latch opening function of the locking circuit in the absence of agreement between any two pulses in corresponding positions in the comparison circuit, such blocking of said opening function not being discernable externally until a serial comparison of the entire series of locking code pulses has been completed, and (e) the logic circuit initiates the latch opening function of the locking circuit only upon the completion of said serial comparison when agreement is found between all compared pulses.

* * * * *